US005439740A

United States Patent [19]

Gat

[11] Patent Number: 5,439,740

[45] Date of Patent: Aug. 8, 1995

[54] COMPOSITE FIBERS HAVING A DIAMOND SURFACE

[75] Inventor: Roy Gat, Cleveland, Ohio

[73] Assignee: Case Western Reserve University, Cleavland, Ohio

[21] Appl. No.: 274,775

[22] Filed: Jul. 14, 1994

Related U.S. Application Data

[62] Division of Ser. No. 950,067, Sep. 23, 1992, Pat. No. 5,358,741.

[51] Int. Cl.[6] ..... D02G 3/00

[52] U.S. Cl. ..... 428/372; 428/375; 428/379; 51/298; 51/307; 451/218; 451/428

[58] Field of Search ..... 51/95, 298, 295, 307, 51/309; 428/375, 372, 379

[56] References Cited

U.S. PATENT DOCUMENTS

| | | | |
|---|---|---|---|
| 3,916,584 | 11/1975 | Howard et al. | 51/295 |
| 3,918,218 | 11/1975 | Zoiss | 51/298 |
| 3,972,161 | 8/1976 | Zoiss | 51/309 |
| 4,247,304 | 1/1981 | Morelock | 51/307 |
| 4,735,924 | 4/1988 | Arons | 51/95 |
| 4,949,511 | 8/1990 | Endo et al. | 51/295 |
| 4,992,082 | 2/1991 | Drawl et al. | 51/295 |
| 5,049,165 | 8/1991 | Tselesin | 51/295 |

*Primary Examiner*—N. Edwards

*Attorney, Agent, or Firm*—Fay, Sharpe, Beall, Fagan, Minnich & McKee

[57] ABSTRACT

The present invention relates to composite fibers having a diamond surface which can be produced using a substrate such as graphite, or other non-diamond inorganic fiber. These substrates produced in the manner described, give rise to improved diamond deposits producing composite fibers having properties not heretofore available.

16 Claims, 5 Drawing Sheets

COMPOSITE FIBERS HAVING A DIAMOND SURFACE

This is a divisional application of U.S. application Ser. No. 950,067 filed on Sep. 23, 1992 now U.S. Pat. 5,358,741 issued Oct. 25, 1994.

BACKGROUND OF THE INVENTION

The present invention relates to composites having a diamond surface and more particularly to composite fibers having a diamond coating as a surface. The present invention also relates to methods of growing of large diamond deposits over large areas and to the growing of polycrystalline films of diamond of controlled orientation and crystallite size.

It is, of course, well known that diamond crystals can be grown or produced "synthetically" by closely controlling the requisite chemical and physical conditions. Such crystals, however, were relatively small in size and weight (i.e. crystals as opposed to a contiguous film). No one has ever attempted to continuously deposit diamond on a fiber substrate to produce a composite fiber.

Typically, the early diamond deposition processes were carried out under extremely high pressures and temperatures, e.g. about 60,000 atmospheres and 1700° C. These conditions were obviously difficult and expensive to maintain and more recent efforts have been directed at the production of diamond crystals under low pressures, i.e. below atmospheric pressure and at more moderate temperatures.

The use of low pressure techniques requires careful control of other conditions, since below atmospheric pressure diamond is the unstable form of carbon, and graphite is the stable form. Thermodynamically, a stable solid should form preferentially over an unstable solid; however, it has been well-established that diamonds can be grown from energetically activated gases at low pressures in spite of the theoretical thermodynamic instability.

Typical conditions at which such diamonds are grown are a total pressure of about twenty (20) Torr, gas composition of one volume percent methane and hydrogen, and a substrate temperature of about 900° C. Typically, energy is added to the gas by a number of means including use of a heated filament, e.g. tungsten, or a microwave discharge. It is generally believed that the energy added to the gas aids growth of the diamond crystal by fragmenting the hydrocarbon molecules, e.g. methane, into a more chemically reactive species such as methyl radicals, and it is also believed to cause the dissociation of the molecular form of hydrogen, $H_2$, to atomic hydrogen, which is also believed to enhance the growth process.

Because graphite is the thermodynamically stable phase of carbon, it was heretofore believed that it, and related graphite materials, should be rigorously excluded from the diamond growth chamber. In fact, it was believed that one of the primary functions of the atomic hydrogen produced in the growth chamber was to remove all traces of graphitic forms of carbon. In order to promote the nucleation of polycrystalline diamond films, the conventional procedure was to treat the surface with diamond powder prior to the growth process. Recently, the work of Angus et al. (U.S. Ser. Nos. 878,717; 878,721; and, 878,255) disclosed techniques for depositing diamond crystals on a variety of substrates including graphite.

DRAWINGS

SUMMARY OF THE INVENTION

Figure 1:
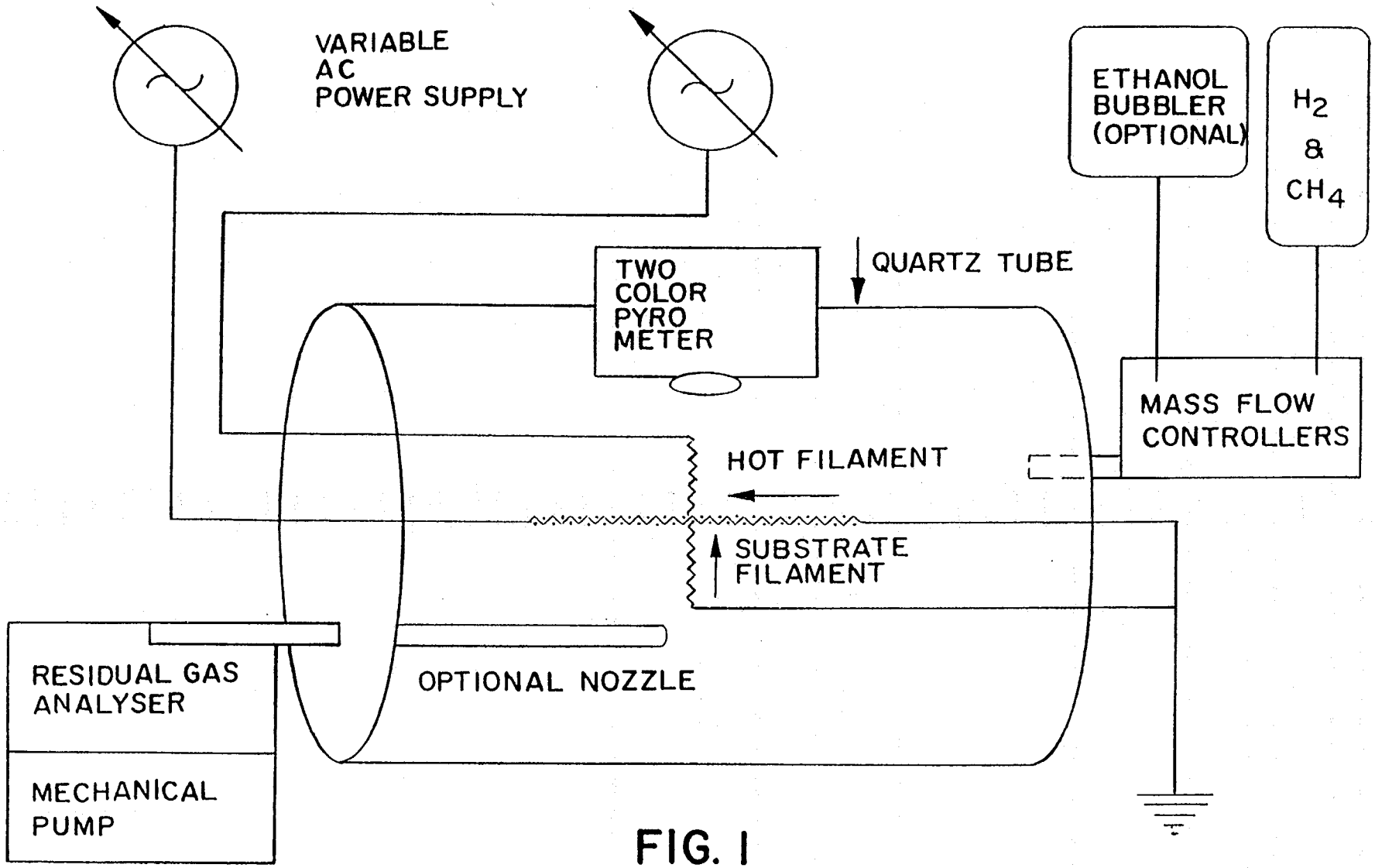
FIG. 1 is a schematic drawing of an apparatus suitable for use in producing composite fibers according to one embodiment of the present invention.

It has now been found that composite fibers having a diamond surface can be produced using as a substrate such as graphite, or other non-diamond inorganic fiber. The use of these substrates in the manner described gives rise to improved diamond deposits producing composite fibers having properties not heretofore available.

In general, the process involves the use of apparatus of the type conventionally used heretofore for subatmospheric pressure deposition of diamond crystals, for example, a heated filament or microwave energy means, a gaseous composition of hydrogen and a suitable gaseous source of carbon such as methane or other hydrocarbon at a pressure of from about 10 Torr to about 100 Torr, and at a temperature of from about 700° C., to about 1450° C.; though higher or lower temperatures and pressures have been employed from time to time, all other conditions being suitable.

Temperatures, pressure, and reactants are all interrelated, and all effect the nature and rate of diamond growth. Generally, at temperatures below about 700° C., the growth rate of the diamond film becomes much slower and the deposit tends to be a smooth polycrystalline film with small, unoriented diamonds, while temperatures above about 1450° C. tend to favor the deposit of graphite. Similarly, below about 10 Torr, the rate of deposit is extremely slow diamonds while at pressures above about 100 Torr, the formation of graphite materials rather than diamonds is favored in hot-filament and microwave reactors. The concentration of gas phase atomic hydrogen is believed to have the greatest impact on the rate of diamond deposition. It will, of course, be obvious that these observations are based on the conditions generally employed herein, and altering conditions and/or reactants could impact the effects observed.

Also, it has been found that when the gas phase concentration of methane becomes too high, non-diamond forms of solid carbon start to precipitate. In conventional hot-filament diamond deposition reactors this occurs at concentrations of hydrocarbon greater than about three volume percent in hydrogen gas. The precipitation of the non-diamond, graphitic forms of carbon in this manner limits the growth rates that one can achieve in hot-filament reactors to around one micron per hour for example. It has been found that, when the deposit is made on graphite, the resulting diamond has a specific orientation with respect to the orientation of the graphite on which it grew.

The use of other inorganic fibers as substrates for diamond crystals and films of diamond is also surprising since these fibers do not all have the same crystal structure as a diamond. It will be even more obvious that, while the growth of superior diamond deposits on a non-diamond substrate is highly unexpected, the deposit of such growths on a graphite substrate is very highly unexpected and clearly contrary to all the teachings heretofore known in the art.

It has been further found that appropriate control of the substrate temperature and the supersaturation of carbon, atomic molecular hydrogen, and oxygen in the gas phase will not only suppress the nucleation of new, non-oriented crystals, but also suppress the reduction of inorganic oxide fibers, and promote the growth of diamond films and crystals with controlled crystal size and hence with very useful properties.

Also, it was observed by Angus et al. that the growth rate of diamond can be strongly increased when the rate of transport of chemical species and of energy to the growing diamond surface is increased. This concept is also believed to be applicable to the present invention with suitable modification of the diamond deposition reactor which could then provide very significant advantages over previous methods.

THE PREFERRED EMBODIMENT

The preferred composites of the present invention have a diamond coating on an inorganic fiber substrates comprising at least one member selected from the group consisting of carbon fibers, silicon carbide (SIC), Boron (B), Boron carbide (BC), Titanium diboride ($TiB_2$), Boron Nitride (BN), Zirconia ($ZrO_2$), beryllium (Be), Silica ($SiO_2$), Alumina ($AL_2O_3$), Aluminum borate and glasses a particularly preferred fiber being graphite fibers formed in situ in the reactor. The substrate fiber may be itself a composite of more than one material, such as silicon carbide coated graphite, a weave or blend of smaller fibers of different composition, or fiber in which each strand is produced from a mixture of inorganic compounds, for example 60% $SiO_2$, 10% $Al_2O_3$ and 30% SiC. As further examples of composites, reference may be had to U.S. Pat. Nos. 5,079,195; 5,041,337; 4,929,513; 4,618,529; and, 4,381,271, the disclosures of which are incorporated herein by reference.

The preferred composition generally has a diameter of from about 0.1 micron to about 100 microns, the substrate to diamond ratio of the diameter being in the range of from about 1:10 to about 1000:1, more preferably in the range of from about 1:1 to about 1:10.

The generally preferred range of experimental conditions for diamond deposition are as follows: Gas composition: 0.5–2% methane or ethanol (or other hydrocarbon) in hydrogen. Graphite fiber temperature: 500°–1500° C. Hot filament temperature 1500°–2500° C. Gas pressure: 5–150T. Distance between hot filament and carbon fibers 0.1–20 cm. Flow rate: 50–200 sccm.

In the preferred method of the present invention, the process is carried out at a temperature of at least about 700° C. employing a gas composition of from about ½ to about 3% hydrocarbon and hydrogen. The preferred range of concentration of hydrocarbon in the gas composition can be higher when oxygen-containing compounds such as ethanol or acetone are employed or a higher concentration of atomic hydrogen is achieved near the substrate. The preferred composition and pressure range can also be extended by providing means for enhancing the rate of transport of the active species to the substrate. These active species are believed to be, for example, atomic hydrogen and methyl groups. A particular means of enhancing the transport rates of these and other active species by using a rapidly moving substrate is described in Angus et al.

There are many methods well known to these skilled in the art to enhance nucleation by surface modification such as scratching with diamond powder, ultrasonic surface treatment, and the like. When non-graphite fibers are employed, it may be of advantage to coat such fibers with a condensed aromatic ring compound as taught by Angus et al. Perylene tetracarboxylic acid dianhydride (PTCDA) is one preferred condensed aromatic ring compound (hereinafter referred to as "ring compound(s)"); however, it will be obvious that there are a number of similar compounds which can be employed, the critical condition being that the compound must be one which will remain nonvolatile under the anticipated experimental conditions. Thus, as with all materials used in producing the composites of the present invention, there are compounds which might be unsuitable for use where the process is conducted at the upper portion of the temperature range, i.e. between 1300° to about 1400° C., which would still be very useful if employed where the process is conducted at the lower portion of the temperature range, i.e. about 700° C. to about 900° C.

Also, the effectiveness of a particular material as a nucleating agent for diamond will depend critically on the rate at which treated substrate is heated and whether or not the particular material forms a chemical bond with the substrate being used. Rapid heating will aid in reaching the diamond nucleating conditions before the nucleating agent has had time to vaporize away. If an otherwise volatile nucleating agent forms a strong chemical bond with the surface of the substrate, it may remain nonvolatile and attached to the substrate at high temperatures where it can be effective in promoting nucleation. Compounds containing oxygen may, for example, form Si-O- bonds with a silicon surface.

The following examples will serve by way of illustration and not by way of limitation to further describe the process of the present invention and the results which can be achieved by employing it.

EXAMPLE 1

A horizontal tube Hot Filament Chemical Vapor Deposition reactor of the type described in FIG. 1 was used for the depositions. A tungsten filament at 2000° C. positioned perpendicular to the tube axis was used to excite the gas. The carbon fibers were position parallel to the tube axis and perpendicular to the hot filament.

The reactor walls were quartz and the flanges were stainless steel. The filament electrodes were molybdenum.

All four electrodes were mounted on the upstream flange. The mountings must affect low leak rates, mechanical stability, axial motion, and electrical insulation from the flange. This was affected by teflon sleeves made to fit tightly over the ¼' Mo rods and inserted into bored through ⅜' swagelocs.

The carbon was supplied via an ethanol bubbler where hydrogen gas was bubbled through ethanol and the flow of ethanol was determined by the partial pressure of ethanol.

EXAMPLE 2

The procedure of Example 1 was repeated, except that the carbon was supplied via methane gas premixed and fed into the reactor chamber.

EXAMPLE 3

Figure 2:
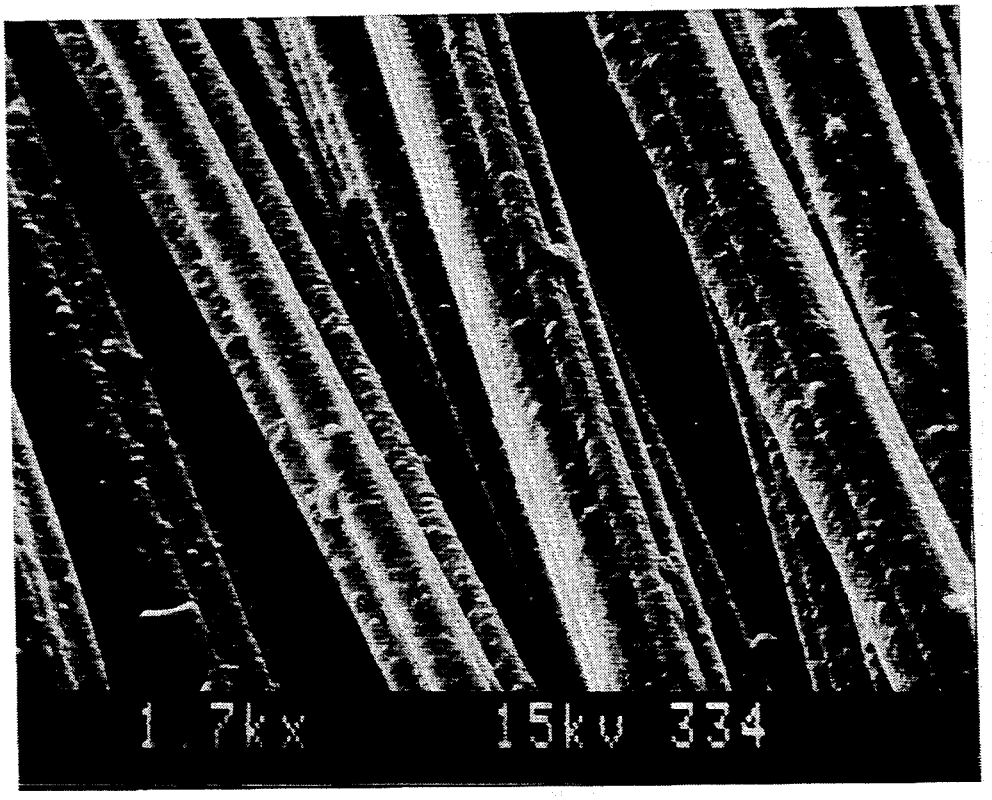
FIGS. 2–4 are photomicrographs of composites produced in the Example 3 hereinafter.
Figure 3:
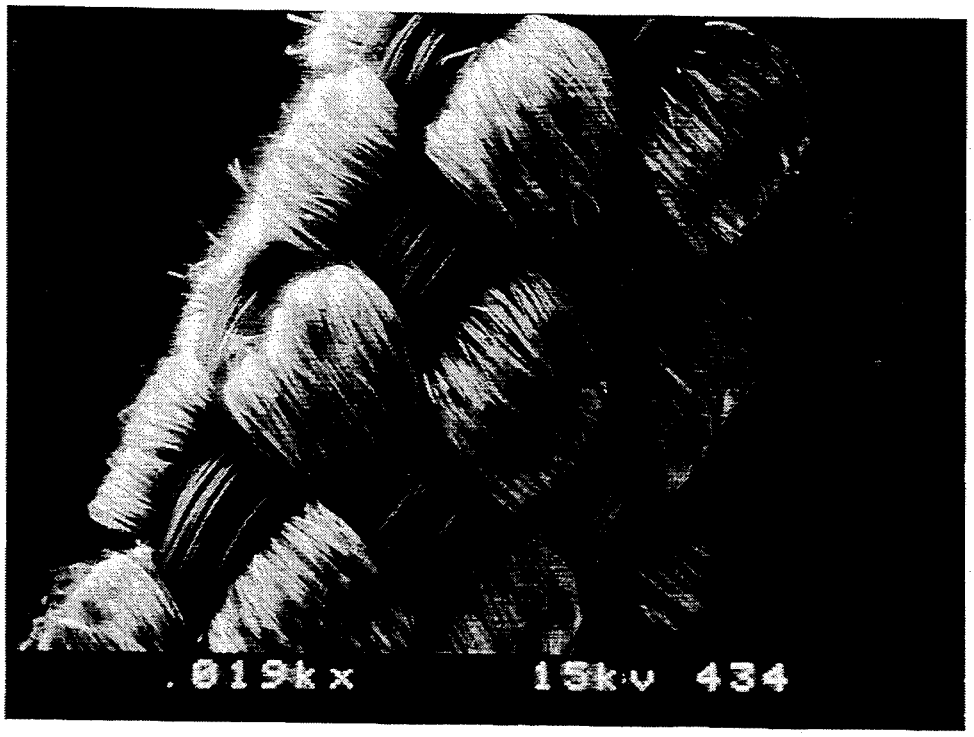
Figure 4:
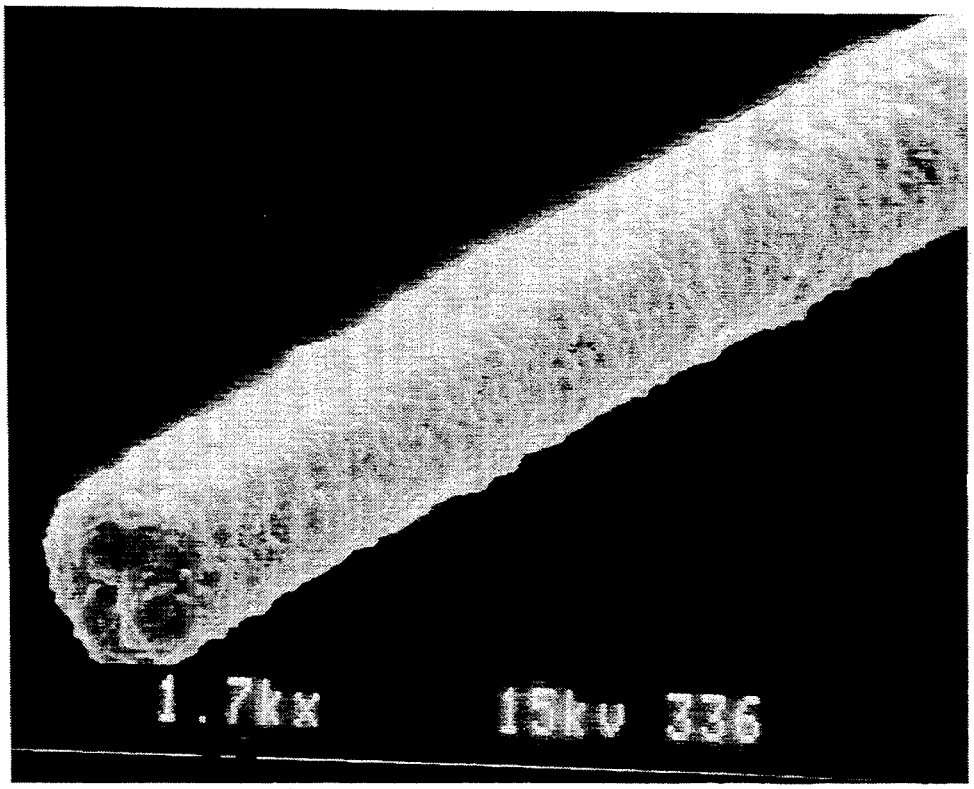
Figure 5:
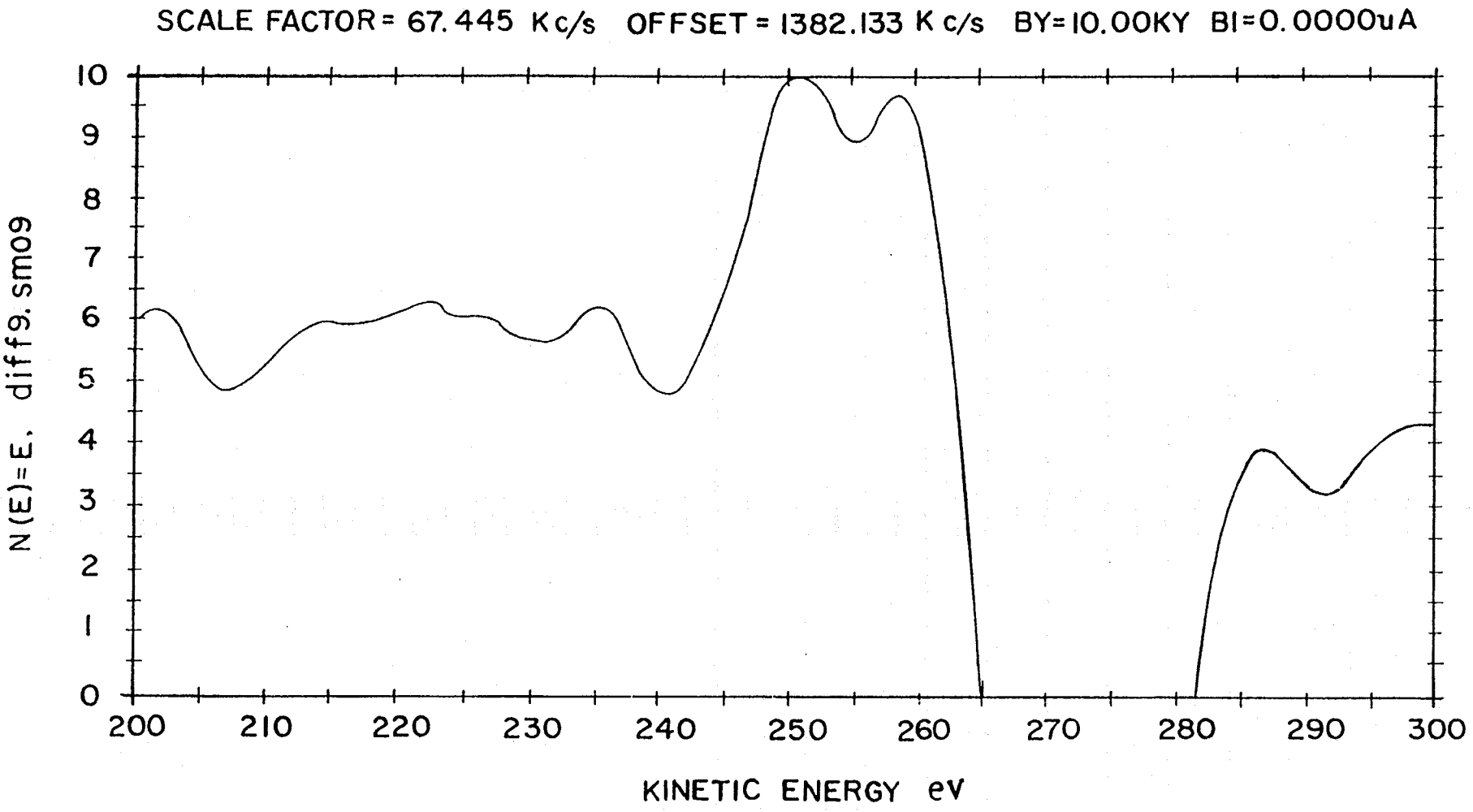
FIG. 5 is an Auger electron spectroscopy scan of the composite of Example 3.

Commercial carbon fibers woven into a carbon cloth were used as substrate. The cloth was heated electrically to 850° C. and the usual diamond deposition conditions as described in the earlier examples were applied. The graphite cloth was subjected to a 15 seconds ultrasonic bath in ethanol and $\frac{1}{2}$–$\frac{1}{4}\mu$ diamond powder before deposition. The result was 100% coverage of the fibers by diamond as confirmed by SEM and AES, as shown in FIG. 2. Bending the cloth did not cause the diamond to delaminate from the carbon fibers, as shown by FIG. 3. Examination of the composite suggests that the diamond crystals are probably oriented radially around the substrate fiber, transverse to the axial direction of the fibers, though this is not conclusively established.

This new composite of diamond coated carbon fibers exhibited superior oxidation resistance, and can be expected to exhibit superior thermal conductivity, and strength to the widely used carbon fibers.

The following tables illustrate the improved properties which can be achieved with diamond fibers in comparison with conventional materials.

TABLE 1

Youngs modulus of some whiskers and diamond

| Material | Youngs Modulus PSI × $10^6$ |
|---|---|
| Diamond | 148 |
| $Al_2O_3$ | 76 |
| Iron | 28 |
| $Si_3N_4$ | 55 |
| SiC | 70 |
| Si | 26 |

TABLE 2

Thermal conductivity of some materials

| Material | Thermal Conductivity W/mK |
|---|---|
| Diamond | 2000 |
| Silver | 407 |
| Copper | 384 |
| Aluminum | 210 |
| Teflon | 0.25 |

Carbon fibers can be made by a number of methods well known to those skilled in the art, including extruding organic precursors, e.g. pitch, into fibers and then subjecting the fibers to heat treatments up to 3000° C. Rayon and more recently Polyacrylonitrile (PAN) fibers are also widely used as the precursor fiber. As noted earlier, one of the preferred methods of the present invention is the deposition of carbon fibers in situ, e.g. on a heated substrate from hydrocarbon gases in the presence of catalysts. The latter method is basically a form of Catalytic Chemical Vapor Deposition (CCVD).

Thus, the CCVD process was employed to deposit carbon fibers in a hot filament assisted CVD reactor under conditions that are close to the growth conditions of diamond films. The catalysts were transported to the substrate surface by gas phase diffusion. The structure of the fibers was determined by Secondary and Transmission Electron Microscopy (SEM and TEM), and their composition by Auger Electron Spectroscopy (AES). The in situ deposition of graphite fibers and graphite/diamond composite fibers are described in Examples 4 and 5.

EXAMPLE 4

The reactor was as described in detail in the earlier examples. The carbon was supplied via an ethanol bubbler where hydrogen gas was bubbled through ethanol and the flow of ethanol was determined by the partial pressure of ethanol. The substrate used was tungsten wire 0.75 mm in diameter. During the deposition process, both the substrate and hot filament are carburized to some extent.

Carbon fibers were deposited under normal diamond growth conditions except that the substrate temperature was raised to between 1200° C. and 1500° C. In this range, graphite fibers were deposited. The substrate temperature was measured by a calibrated double wavelength pyrometer or a disappearing filament pyrometer. The morphology of the fibers was found to vary from blunted to pointed, and the surface roughness of the fibers varied from 0.1–0.3$\mu$. The growth rate was between 1 and 10$\mu$/hr and the number density of fibers was up to $10^6$ $cm^{-2}$.

Thus, for the first time a HFCVD reactor for diamond was used to deposit graphite fibers with silicon and iron being transported to the substrate via the gas phase to catalyse the deposition. Electron images and diffractions of the fibers provide ample evidence that the fibers are composed of turbostratic graphite and are not diamond whiskers (filamentary diamond). The graphite basal planes are wrapped around the fiber axis. A large degree of rotational disorder exists between the layers but interlayer separations remain approximately equal to graphite.

EXAMPLE 5

Example 4 was repeated and reactor conditions were then adjusted to deposit diamond into the in situ graphite fiber. The original and adjusted reactor conditions are set forth in Table 3.

TABLE 3

Experimental conditions for the two steps of fiber growth. $T_3$ is the substrate temperature (°C.), P is reactor pressure (torr), $F_{eth}$ is the flow rate of hydrogen through the ethanol bubbler (sccm), and $F_H^2$ is the hydrogen flow rate (sccm).

| Parameter | Diamond Growth | Fiber Growth |
|---|---|---|
| P | 20–30 | 20–30 |
| $T_3$ | 900–1100 | 1200–1500 |
| $F_{eth}$ | 10–20 | 10–20 |
| $F_H^2$ | 100 | 100 |

The presence of Si and Fe catalysts did not interfere with further diamond deposition and diamond was deposited on top of the fibers. Thus, it is possible to sequentially produce both the graphite fiber and the diamond coating in the same reactor.

By adjusting the reactor conditions, and using a suitable gaseous precursor, other inorganic fiber substrates can also be deposited in situ.

It is apparent that there has been provided in accordance with this invention a process and apparatus for producing improved diamond deposits, in situ graphite fiber deposits, and novel diamond fiber composites which fully satisfies the objects, means, and advantages set forth hereinbefore. While the invention has been described in combination with the specific embodiments thereof, it is obvious that many alternatives, modifications, and variations will be apparent to those skilled in the art in light of the foregoing description. Accordingly, it is intended to embrace all such alternatives, modifications, and variations as fall within the spirit and scope of the appended claims.

Having described the invention, the following is claimed:

1. A fiber composite comprising a continuous diamond coating directly deposited on an individual inorganic fiber substrate wherein said diamond coating surrounds substantially all of said fiber substrate.

2. The composite according to claim 1 wherein said inorganic fiber substrate is at least one member selected from the group consisting of carbon fibers, silicon carbide (SIC), Boron (B), Boron carbide (BC), Titanium diboride ($TiB_2$), Boron Nitride (BN), Zirconia ($ZrO_2$), beryllium (Be), Silica ($SiO_2$), Alumina ($AL_2O_3$), Aluminum borate and glasses.

3. The composite according to claim 2 wherein said fiber substrate is graphite.

4. The composite according to claim 3 wherein said graphite fiber substrate has been formed in situ in a reactor subsequently employed to deposit said diamond coating.

5. The composite according to claim 1 wherein said composite has a diameter in the range of from about 0.1 to about 100 microns.

6. The composite according to claim 2 wherein said composite has a diameter in the range of from about 0.1 to about 100 microns.

7. The composite according to claim 3 wherein said composite has a diameter in the range of from about 0.1 to about 100 microns.

8. The composite according to claim 4 wherein said composite has a diameter in the range of from about 0.1 to about 100 microns.

9. The composite according to claim 5 wherein the ratio of the inorganic fiber to the diamond deposit in the diameter of the composite is in the range of from about 1:10 to about 1000:1.

10. The composite according to claim 6 wherein the ratio of the inorganic fiber to the diamond deposit in the diameter of the composite is in the range of from about 1:10 to about 1000:1.

11. The composite according to claim 7 wherein the ratio of the inorganic fiber to the diamond deposit in the diameter of the composite is in the range of from about 1:10 to about 1000:1.

12. The composite according to claim 8 wherein the ratio of the inorganic fiber to the diamond deposit in the diameter of the composite is in the range of from about 1:10 to about 1000:1.

13. The composite according to claim 2 wherein said inorganic fiber is alumina.

14. The composite according to claim 2 wherein said inorganic fiber is zirconia.

15. The composite according to claim 2 wherein said inorganic fiber is boron nitride.

16. The composite according to claim 2 wherein said inorganic fiber is titanium diboride.

* * * * *